US012565399B2

(12) United States Patent
Alford et al.

(10) Patent No.: US 12,565,399 B2
(45) Date of Patent: Mar. 3, 2026

(54) MULTI-CABLE CORD REEL SYSTEM

(71) Applicants: John Alford, Mundelein, IL (US); Paul C. Burke, Lake Forest, IL (US)

(72) Inventors: John Alford, Mundelein, IL (US); Paul C. Burke, Lake Forest, IL (US)

(73) Assignee: Konnectronix, Inc., Waukegan, IL (US)

( * ) Notice: Subject to any disclaimer, the term of this patent is extended or adjusted under 35 U.S.C. 154(b) by 327 days.

(21) Appl. No.: 18/379,520

(22) Filed: Oct. 12, 2023

(65) Prior Publication Data

US 2025/0122046 A1 Apr. 17, 2025

(51) Int. Cl.
*B65H 75/38* (2006.01)

(52) U.S. Cl.
CPC ..... *B65H 75/38* (2013.01); *B65H 2701/32* (2013.01); *B65H 2701/34* (2013.01)

(58) Field of Classification Search
CPC . B65H 75/38; B65H 2701/32; B65H 2701/34
See application file for complete search history.

(56) References Cited

U.S. PATENT DOCUMENTS

| | | | | |
|---|---|---|---|---|
| 5,186,406 | A | 2/1993 | Romanelli | |
| 6,220,413 | B1 | 4/2001 | Walters | |
| 2012/0126047 | A1 | 5/2012 | Skowronski | |
| 2013/0076217 | A1 | 3/2013 | Thompson | |
| 2013/0171865 | A1 | 7/2013 | Ceraldi | |
| 2013/0284843 | A1 | 10/2013 | Mertesdorf | |
| 2014/0174377 | A1 | 6/2014 | Geller | |
| 2015/0308425 | A1* | 10/2015 | Skotty | F04B 35/04 417/63 |
| 2016/0229663 | A1* | 8/2016 | Alford | H02G 11/02 |
| 2019/0256320 | A1* | 8/2019 | Hinojosa | H02G 11/02 |

FOREIGN PATENT DOCUMENTS

CA 2296949 A1 7/2000

OTHER PUBLICATIONS

PCT Search Report and Written Opinion dated Sep. 21, 17 in Application No. PCT/US2017/027875.
JINPAT Electronics Co. Ltd., brochure, copyright 2015.

* cited by examiner

*Primary Examiner* — Sherman Ng
(74) *Attorney, Agent, or Firm* — Vitale, Vickrey, Niro, Solon & Gasey LLP

(57) ABSTRACT

A system for simultaneous connection and transmission of data and/or power signals through a construction involving both fiber optic and conventional conduction cords. More specifically, a unitary construct comprising a plurality of bound cords, preferably, having at least one fiber optic cord and at least one conventional cord contained within a larger unitary construction, with one end of the construction being retracted into or guided out of a spool for quick deployment to enable a plurality of connectors to make a quick and substantially simultaneous deployment across a variety of cable media.

6 Claims, 4 Drawing Sheets

MULTI-CABLE CORD REEL SYSTEM

FIELD OF INVENTION

The present disclosure relates to a system for simultaneous connection and transmission of data and/or power signals through a unitary construction involving both fiber optic and conventional conduction cords. More specifically, the present disclosure includes a construct comprising a plurality of bound cords preferably having at least one fiber optic cord and at least one conventional cord contained within a larger unitary construction, the construction being retracted into or guided out of a spool for quick deployment to enable a plurality of connectors at an end of the construct to provide a quick and substantially simultaneous deployment of connectors across a variety of cable media.

BACKGROUND OF THE INVENTION

Retractable reels have been used in various applications to retractably store various types of cables or cords. For example, one successful cord reel assembly has been developed that comprises a spool on which the extendable portion of cord is held, and an expansion chamber in which a fixed length of cable is spirally wound. The two cable portions are connected, typically in or adjacent to the hub of the spool. As the spool rotates the spirally wound, fixed cable expands and contracts within the expansion chamber. Examples of reels of this type are disclosed in U.S. Pat. No. 5,094,396 to Burke and U.S. Pat. No. 8,075,335 to Burke et al., the disclosures of which are hereby incorporated by reference.

Retractable cord reels have been used in various applications to retractably store various types of cables. Using a reel provides convenient storage for the cord. The reel also protects the cord from damage, since it need not be left on the ground, and thus damage to the cord is reduced. In the case of an electrical cord reel, the hazard presented to a user by a damaged electrical cord is also avoided. However, certain types of applications require different types (and numbers) of cables. For instance, conventional electrical cables, e.g., with copper wires or similar conductors, may be used for power or energy transmission and low-end data information transmission, such as telephone connections. By contrast, fiber optic cables can be used for long distance, large and strong capacity communications or the like. Moreover, such cables may require a multiplicity of different form factors and connectors depending upon the equipment that it is expected to connect.

Unfortunately, given the wide array of different cables and cable connection combinations that may be required for a given set of communications equipment, the user is left with a number of options, each of which is undesirable. That is, the user may need to employ a number of different cables creating undue "cable spaghetti" and corresponding safety and/or operational hazards. While there exist certain devices, such as the spools referenced above, such spools can only guide a single cable. Thus, using multiple spools for multiple cables would be an unsatisfactory solution to the problem posed.

In order to provide a more durable and more reliable system for connecting to and supporting electronics attached to cords and/or cord reels, it is necessary to provide a mechanism to enable the rapid connection of multiple cables of various types (fiber optic, power, and or conventional data cables) from a power and/or data source to a connection location that has multiple connection points. To date, however, there are no available products that permit an assembly comprising a groups of cords of varying transmission types with different connectors to establish quick and reliable connections through a single piece of equipment.

What is needed is a system including the ability to promptly and safely connect and deploy a bundle of cables using a single containment device.

Definition of Terms

The following terms are used in the claims of the patent as filed and are intended to have their broadest plain and ordinary meaning consistent with the requirements of the law.

A "connector" means a component for keeping an optical or electrical connection between a cable and an outlet, or a piece of communications equipment or a power source, or a data source. Examples of such connectors vary but would include at least:

For RF Cables: BNC, UHF, N, TNC, SMA

For Ethernet Cables: RJ45

For Fiber Cables: ST, SC, LC, MPO

For Power Cables: Circular Connectors, Power Plugs, D-Sub

These examples as well as conventional power and signal connectors (e.g., power connectors on the order of about 1-100 amps) known to those of skill in the art are included within the scope of this term.

A "spinner" refers to electromechanical devices that allow the transmission of power and electrical signals from a stationary to a rotating structure, ('or vice versa'). It also includes, but is not limited to slip rings.

A "braided jacket" refers to a covering that is applied over cables and conductors. This can be a woven material or extruded material that keeps the wire assembly together and also protects the inner cables and conductors.

A "processor" refers to a computer that can be accessed by authorized personnel, such as a service technician, owner, specialist or the like through a number of different structures.

Where alternative meanings are possible, the broadest meaning is intended. All words used in the claims set forth below are intended to be used in the normal, customary usage of grammar and the English language.

OBJECTS AND SUMMARY OF THE DISCLOSURE

The apparatus and method of the present disclosure generally includes a construct comprising multiple cables, (either optical, electrical or mechanical) that is preferably connected to a reel or spool. Such a cable construct and reel system will typically include one or more fiber optic cables and one or more multi-conductor power and/or data cable. Each cable in this construct will be surrounded by a braided jacket so as to create a single unitary cable construct. The system further, preferably, includes a spool for housing the unitary cable construct when retracted and for extending one end of the cable construct in order to enable connections to communication and/or power equipment. The housing or spool encloses spinners or slip rings for each cable within the unitary cable construct to maintain data and/or power supply within each cable of the construct during spooling and unspooling. Preferably, each cable within the unitary cable construct will have connectors at each end which are independent of all the other cables in the construct. Thus, the unitary cable construct can support the quick and easy connection of a single construct into a variety of different connections, having, potentially, a variety of different form factors and functions.

The immediate application of the present invention will be seen in large scale, heavy duty communications systems (e.g., mobile communications systems, including command and control systems on heavy equipment using optical and electrical communications lines), though those of skill will see that the present invention could be applied to electrical cord reel arrays and/or non-vehicle usage (e.g., security usage and commercial electronics usage) where the need to avoid cable clutter may be particularly advantageous.

Thus, it can be seen that one object of the present invention is to provide a system and structure for managing multiple cords with a single spool or reel.

An additional object of the present invention is to provide a system which enables multiple cable connections without requiring a separate cable.

Still another object of the present invention is to provide a unitary cord reel assembly that enables different types of connections (e.g., optical, electrical, mechanical) using a single cord construct.

Further, another object of the present invention is to provide a cord reel assembly that provides different types of form factor connections using a unitary or single cord construct.

One other object of the present invention is to provide a cord reel assembly that enables the quick and safe establishment of multiple electronic and optical cable connections, using a single unitary cable construct and a spool which provides stationary and retractable portions for each cable within the unitary cable construct.

It should be noted that not every embodiment of the claimed invention will accomplish each of the objects of the invention set forth above. In addition, further objects of the invention will become apparent based on the summary of the invention, the detailed description of preferred embodiments, and as illustrated in the accompanying drawings. Such objects, features, and advantages of the present invention will become more apparent in light of the following detailed description of various embodiments thereof, and as illustrated in the accompanying drawings.

DETAILED DESCRIPTION OF THE INVENTION

Set forth below is a description of what is currently believed to be the preferred embodiment or best examples of the invention claimed. Future and present alternatives and modifications to this preferred embodiment are contemplated. Any alternatives or modifications, which make insubstantial changes in function, in purpose, in structure or in result, are intended to be covered by the claims in this patent.

Figure 1:
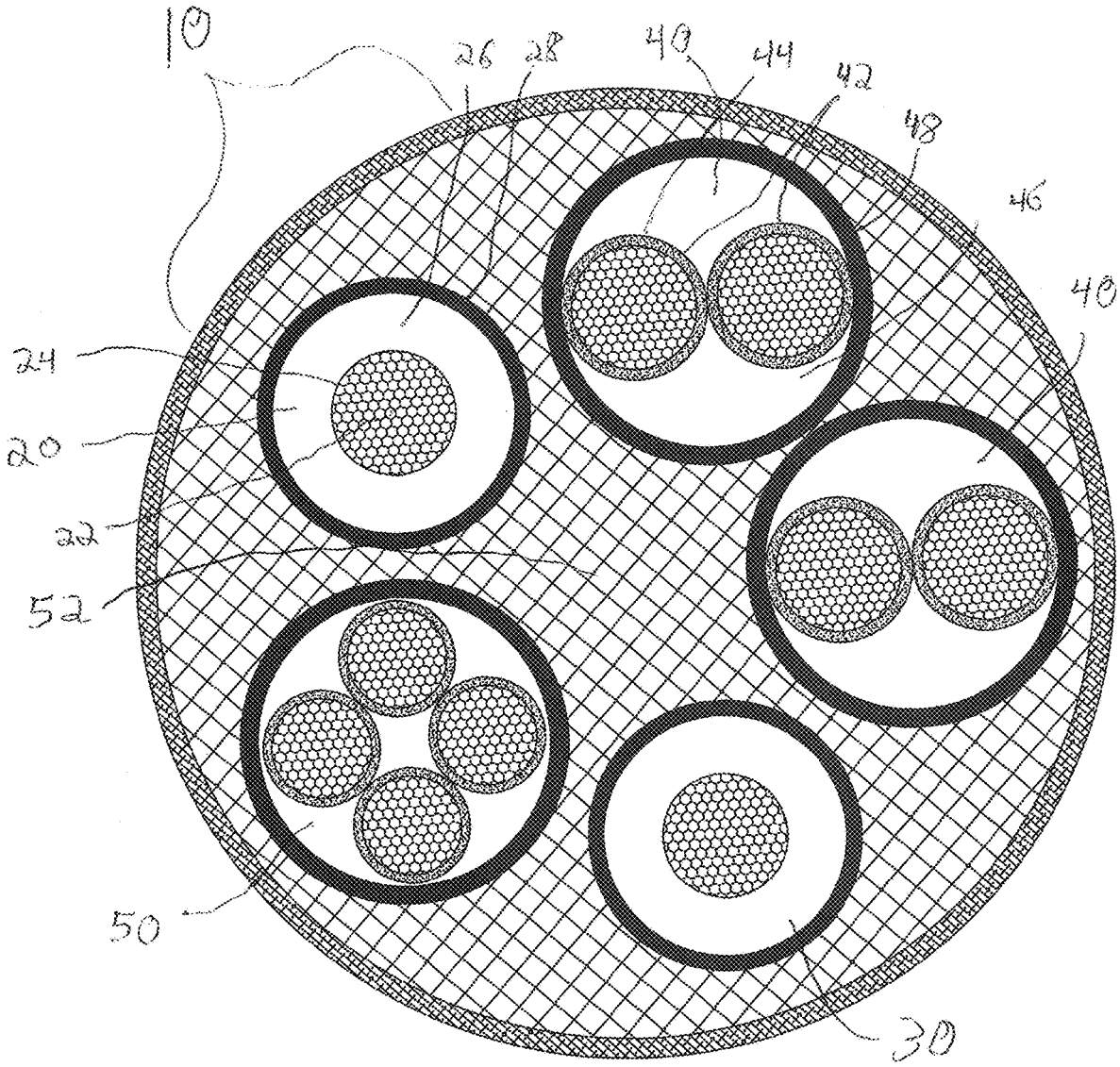
FIG. 1 shows a cross section view of a first example embodiment of unitary cable construct in accord with one preferred embodiment of the present invention.

FIG. 1 shows an example unitary cable construct 10 in accord with a first preferred embodiment of the present invention. Specifically, unitary cable construct 10 includes a plurality of fiber optic cables 20, 30, an electronic data cable 40 and an electronic power and data cable 50. Ideally, the construct 10 should try to place the fiber optic cable(s) 20, 30 in the center of the construct. Further, the construct 10 should try to place any electronic power cables 50 away from electronic data cables 40, especially where such data cables are high speed coaxial cables, in order to lessen the likelihood of interference. Each fiber optic cable preferably includes at least a fiber core 22, which transports light pulses generated by a laser or LED. Single-mode cores are typically 8.3 or 9 μm in diameter, while multimode cores are available in 50 and 62.5 μm diameters. Each fiber optic cable optionally includes cladding 24, which protects and surrounds the core 22, reflecting light back into the core causing light waves to travel the length of the fiber core. Next, each fiber optic cable further, preferably, includes a coating or plastic layer 26, which absorbs shocks and prevents excessive pending and reinforce the core 22. Finally, each fiber optic cable includes an outer jacket or cable jacket 28 for protection.

The electronic data cable 40, also shown in FIG. 1, illustratively comprises a plurality of elongated, seamless conductive members 42, each having a conductor substantially covered by an insulating layer 44, the conductive members being positioned and including filler or an insulator 46 so as to form a round cord which is covered by an outer jacket 48. The data and power cable 50 is substantially similar in cross section in this embodiment, with the exception that the conductors 42 may conduct power, instead of data. Moreover, the data and power cable 50 is preferably separated from the data cable 40 by the optical cables 20, 30 so as to prevent cross talk between the conductors 42.

Figure 2:
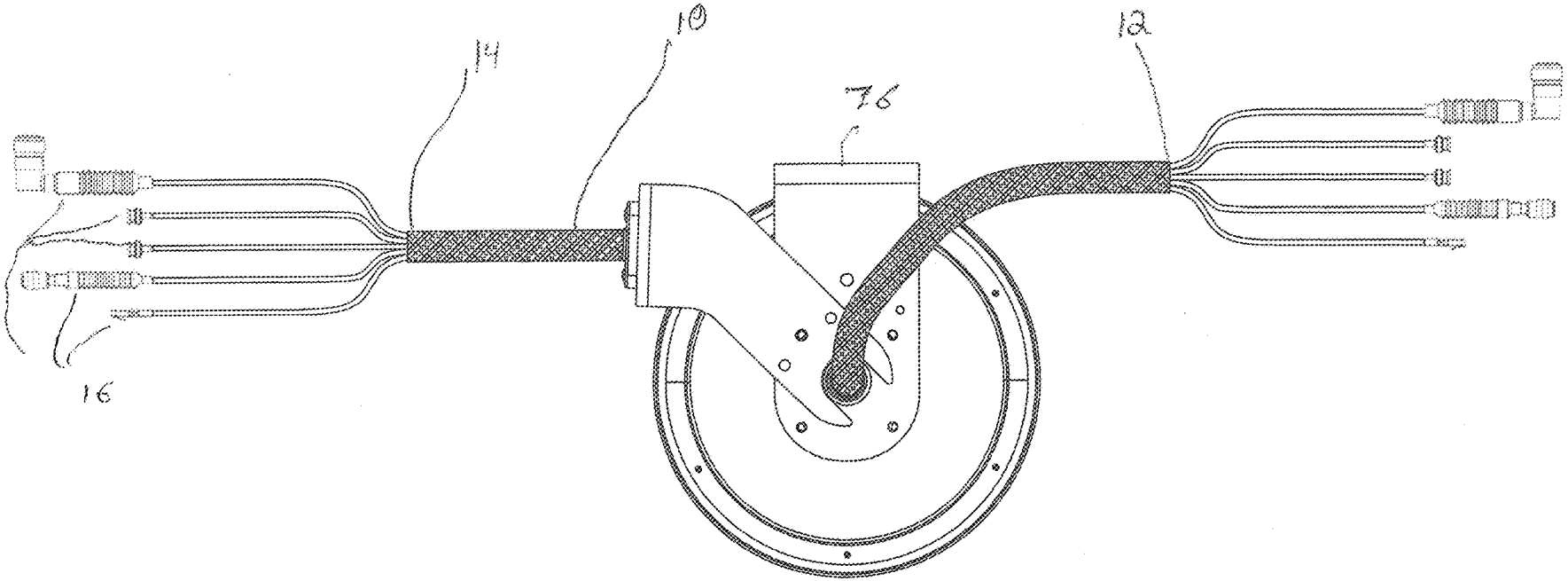
FIG. 2 shows a side view showing the components of a unitary cable construct with example connectors in accord with another embodiment of the present invention.
Figure 3:
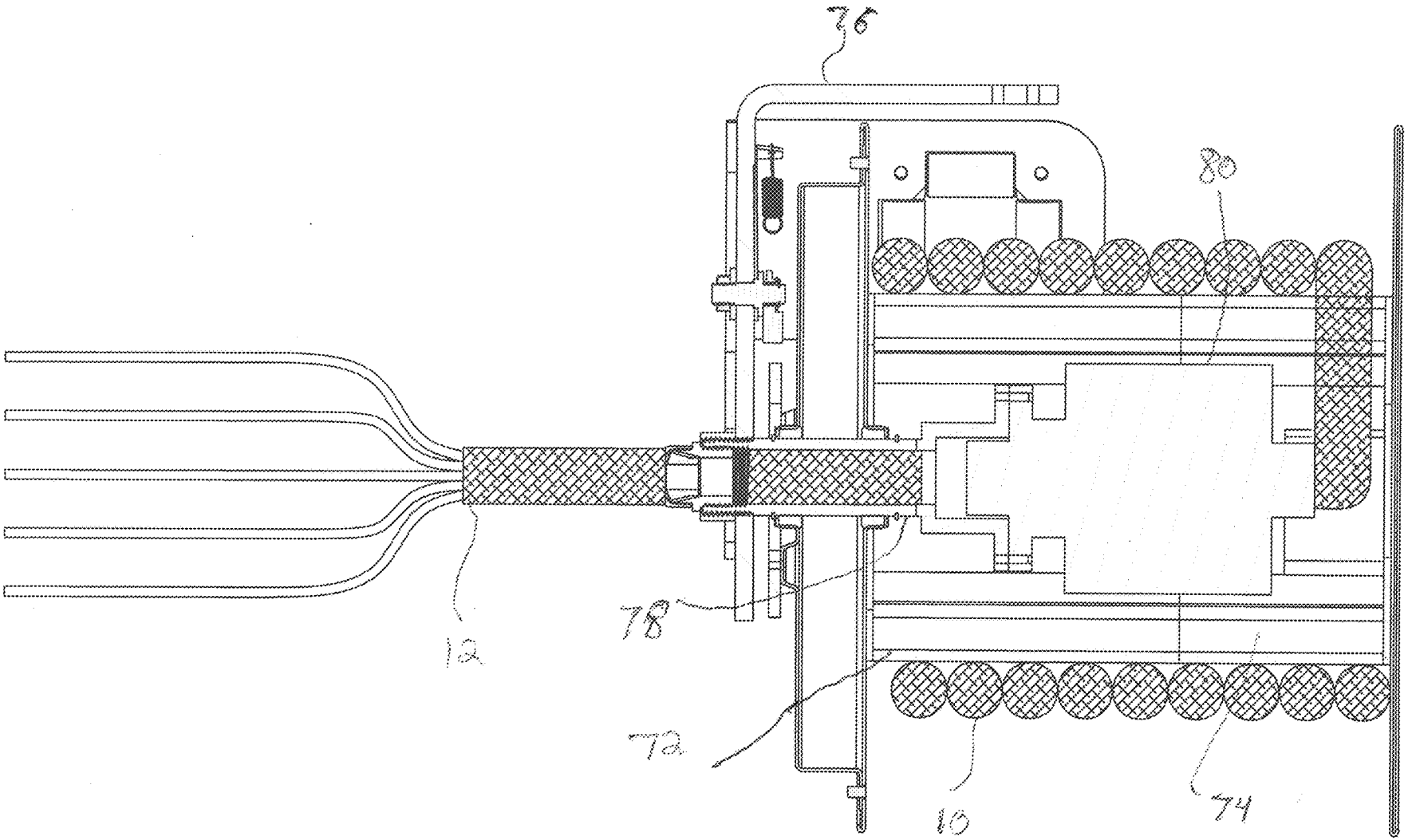
FIG. 3 shows a lateral view of a unitary cable construct on a spool showing spinner features for the unitary cable construct in accord with another embodiment of the present invention.
Figure 4B:
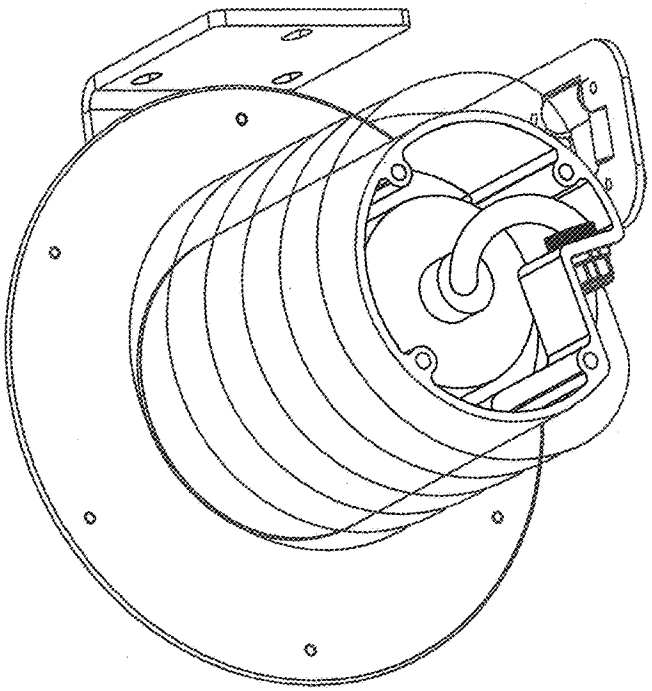
FIGS. 4*a* and 4*b* show an example spinner without and with the unitary cable construct, respectively, as used in accord with another embodiment of the present invention.
Figure 4A:
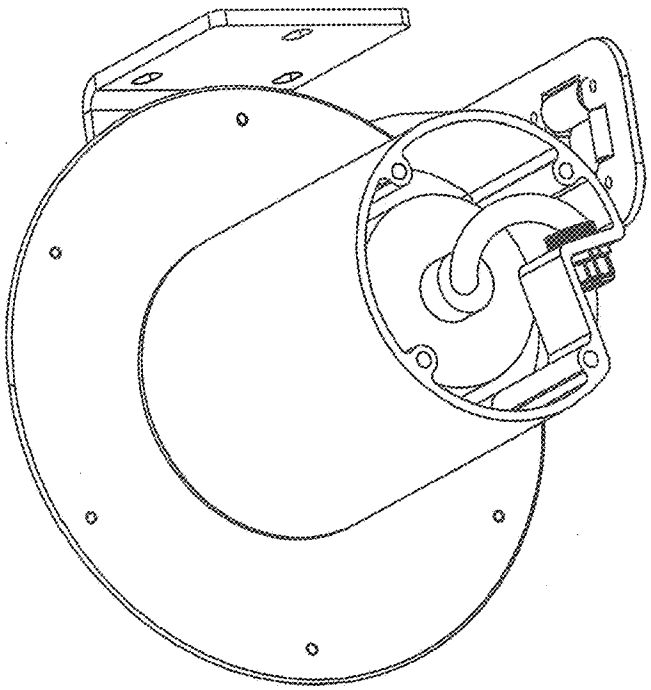

The construct 10 is, preferably, comprised of multiple cables, whether optical 20, 30, electrical data 40, electrical data and power 50, or mechanical (not shown). As shown in FIG. 1, the construct 10 is bound together by an outer braided jacket 60 and (optionally) an insulative core 52 to better provide a circular cross section for each of the operations with the spool 70. Alternatively, an optical cord 20 can occupy the central location of the construct 10 to provide better protection for the optical connection. As shown in FIG. 2, the construct 10 has a first or stationary end 12 and a second or retractable end 14. Each end 12, 14, has connectors 16 for each cable in the construct 10 to enable separate connection points for the data or power being transmitted on each cable, with different connectors 16 being used, including standard connectors, such as, but not limited to, ferrule core (FC) connectors, MT-RJ connectors, or MPO (multi-position optical connectors) for optical cables. The connectors 16 for the electrical cables, 40, 50, by comparison, may preferably employ coaxial connectors, BNC, UHF, N, TNC, SMA, RJ 45 or data and power connectors known to those of skill in the art.

As shown in FIGS. 2, 3 and 4*a* and 4*b*, the cable construct has a first or stationary end 12 and a retractable end 14, which meet at the spool 70. Optionally, the spool may be formed of two halves 72, 74, but does not include a housing because of the need for heat dissipation. Rather, the halves, along with spinner 80, may be mounted on a bracket 76 connected to a shaft (not shown). The core 78 of the spool has the unitary construct 10 extending therefrom towards the first or stationary end 12 to connect to power or data sources (not shown) as desired. At the core 78 of the spool 72, each cable of the unitary construct employs a single spinner 80 (or alternatively, a slip ring mechanism, not shown). Additionally, the spool 70 may include temperature sensors which communicate with a remote processor (not shown) to let a user or owner know whether the temperature conditions have jeopardized the safety and/or operation of the construct 10.

The spinner 80 maintains data and power supply through the unitary multi-cable construct 10 within each cable inside of the construct. That is, the construct, and each cable inside of it, comprises a stationary component, which extends from the spinner 80 to the first end 12, and a retractable component, which extends from the spinner 80 to the second end 14. This connection enables the extendable end 14 of the construct 10 to be spooled or unspooled without jeopardizing the connections between the power and data sources and the first end 12 of the construct.

The above description is not intended to limit the meaning of the words used in the following claims that define the invention. Rather, it is contemplated that future modifications in structure, function or result will exist that are not substantial changes and that all such insubstantial changes in what is claimed are intended to be covered by the claims. For instance, those having the teaching of the present invention understand that it may encompass a construct lacking a fiber optic cable, but rather comprising one or more electrical data cables, electrical power cables, and/or electrical power and data cables. Likewise, it will be appreciated by those skilled in the art that various changes, additions, omissions, and modifications can be made to the illustrated embodiments without departing from the spirit of the present invention. All such modifications and changes are intended to be covered by the following claims.

What is claimed is:

1. A cord construct and reel system comprising:

a) a plurality of fiber optic cables and at least one multi-conductor power and data cable;

b) a braided jacket containing the plurality of fiber optic cables and the, at least, one multi-conductor power and data cable therein, so as to provide a unitary multi-cable construct;

c) a spool for spooling and unspooling the unitary multi-cable construct; and d) a spinner for maintaining data and power supply through the unitary multi-cable construct from the plurality of fiber optic cables and the, at least, one multi-conductor power and data cable in the unitary multi-cable construct during spooling and unspooling.

2. The cord construct and reel system of claim 1, wherein each of the plurality of fiber optic cables and at least one multi-conductor power and data cable further comprises a first end and a second end, and wherein each of the first and second ends has a connector thereon, each of the first end connectors connecting to a power and data supply source, and each of the second end connectors connecting to communications and/or power equipment.

3. A cord construct and reel system comprising:

a) a plurality of multi-conductor power and data cables;

b) a braided jacket containing the plurality of multi-conductor power and data cables therein so as to provide a unitary multi-cable construct;

c) a spool for spooling and unspooling the unitary multi-cable construct; and d) a spinner for maintaining data and power supply through the unitary multi-cable construct from the plurality of multi-conductor power and data cables in the unitary multi-cable construct during spooling and unspooling.

4. The cord construct and reel system of claim 3, wherein each of the plurality of multi-conductor power and data cables further comprises a first end and a second end, and wherein each of the first and second ends has a connector thereon, each of the first end connectors connecting to a power and data supply source, and each of the second end connectors connecting to communications and/or power equipment.

5. A cord construct and reel system comprising:

a) at least one multi-conductor data cable and at least one multi-conductor power and data cable;

b) a braided jacket containing the, at least, one multi-conductor data cable and at least one multi-conductor power and data cable therein so as to provide a unitary multi-cable construct;

c) a spool for spooling and unspooling the unitary multi-cable construct; and d) a spinner for maintaining data and power supply through the unitary multi-cable construct from the plurality of multi-conductor data cables and the, at least, one multi-conductor power and data cable in the unitary multi-cable construct during spooling and unspooling.

6. The cord construct and reel system of claim 5, wherein each of the least one multi-conductor data cable and at least one multi-conductor power and data cable further comprises a first end and a second end, and wherein each of the first and second ends has a connector thereon, each of the first end connectors connecting to a power and data supply source, and each of the second end connectors connecting to communications and/or power equipment.

* * * * *